United States Patent [19]

Leavitt et al.

[11] 4,180,167

[45] Dec. 25, 1979

[54] CARTON HAVING RECLOSABLE SPOUT

[75] Inventors: David R. Leavitt, Kirkland; Gerald R. Pfieffer, Seattle, both of Wash.

[73] Assignee: Container Corporation of America, Chicago, Ill.

[21] Appl. No.: 910,490

[22] Filed: May 30, 1978

[51] Int. Cl.[2] ..... B69D 5/74

[52] U.S. Cl. ..... 206/622; 206/625; 229/17 R

[58] Field of Search ..... 229/17 R; 206/621, 622, 206/625, 626

[56] References Cited

U.S. PATENT DOCUMENTS

| | | | |
|---|---|---|---|
| 1,931,991 | 10/1933 | Mergentheim | 229/17 R |
| 1,940,849 | 12/1933 | Davidson | 206/626 |
| 2,002,005 | 5/1935 | Gottlieb | 206/626 |
| 2,364,364 | 12/1944 | Hultin | 229/17 R |
| 2,565,182 | 8/1951 | Maron | 229/17 R |
| 2,811,297 | 10/1957 | Maxon | 229/17 R |
| 2,889,977 | 6/1959 | Buttery | 229/17 R |
| 2,933,230 | 4/1960 | Yezek | 229/17 R |
| 2,946,496 | 7/1960 | Stagmeier | 229/17 R |
| 3,743,164 | 7/1973 | Clark | 229/17 R |

FOREIGN PATENT DOCUMENTS

| | | | |
|---|---|---|---|
| 90790 | 1/1968 | France | 229/17 R |

*Primary Examiner*—Stephen P. Garbe
*Attorney, Agent, or Firm*—Carpenter & Ostis

[57] ABSTRACT

A folding carton having a reclosable pouring spout is disclosed and consists of a tube of rectangular cross section with pairs of major and minor closure flaps, one of the major closure flaps being folded to closing position underlying at least one gusseted minor closure flap, the other major closure flap being foldably connected to the minor closure flap having gusset elements and having a transverse line of weakness therein, so that a portion of the second major closure flap may be erected with the gusset elements of the minor closure flap to provided a dispensing spout.

In certain embodiments the erectable portion of the second major closure flap may be provided with a diagonal line of fold, so that upon reclosing the gusseted minor closure flap the erectable portion can be reverse folded to reclose the carton.

3 Claims, 15 Drawing Figures

CARTON HAVING RECLOSABLE SPOUT

FIELD OF THE INVENTION

The structure of the present invention finds particular application in the field of sift proof cartons, but improved by the employment of a gusseted minor closure flap cooperating with a major closure flap to provide a dispensing or pouring spout upon opening of the carton.

A feature of the invention resides in the ability to employ the gusseted minor closure flap with a diagonally scored major closure flap portion capable of reverse folding to provide a reclosing feature.

SUMMARY OF THE INVENTION

It is a particular object to provide a carton having a dispensing or pouring spout which is erectable upon opening of the carton and collapsible to reclose the same.

Another aspect of the invention is to provide a reclosable spout irrespective of whether the carton is of the sift proof type or not, the dispensing spout being erectable readily from the carton structure upon opening of the carton.

THE DRAWINGS

SPECIFICATION

Figure 1:
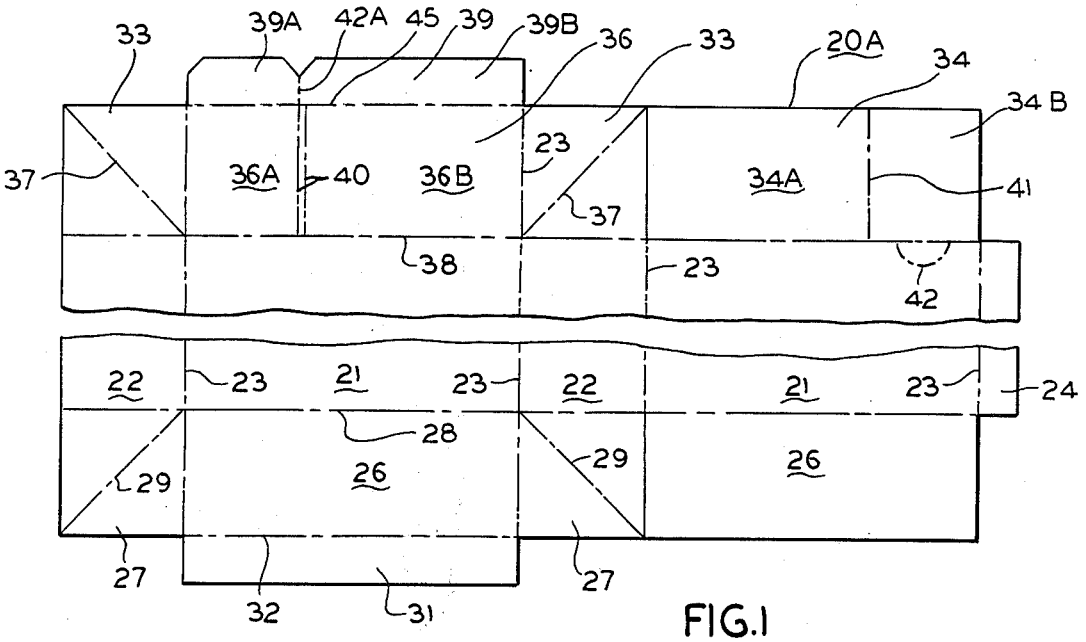
FIG. 1 is a plan view of a folded and scored paperboard blank for constructing a carton according to one embodiment of the invention.

The improved carton according to one embodiment of the present invention is shown in an embodiment thereof wherein same is sift resistant and is provided with a closure structure forming an erectable pouring spout. The carton according to this embodiment of the invention is referred to generally by the reference numeral 20 and is formed from a cut and scored blank 20A of paperboard material or the like. Blank 20A is adapted to be formed into a carton structure seen in FIGS. 2 to 5 inclusive, which structure includes a pair of major side walls 21 and minor side walls 22, all being foldably connected along fold lines 23, there being a flap 24 connected to one of the major side walls 21 along a fold line 23 and adapted to be joined to the remote minor side wall 22 in a fashion well known to form a carton tube.

A closure means, preferably of a sift resistant type, is provided for one of the ends of the major and minor pairs of side walls 21 and 22, such closure means consisting of major closure flaps 26 and minor closure flaps 27, all of these being connected to the previously described major and minor side walls 21 and 22 along a common fold line 28. The minor closure flaps 27 in this case are provided with diagonal score lines 29 providing gusset folds to form a sift proof structure for the lower end of the carton 20 when the carton is erected. A closure flap 31 connected to one of the bottom major closure flaps 26 along a fold line 32 is adapted to be folded into position and adhered to the opposite major wall 21 in a manner well known in the art.

Figure 3:
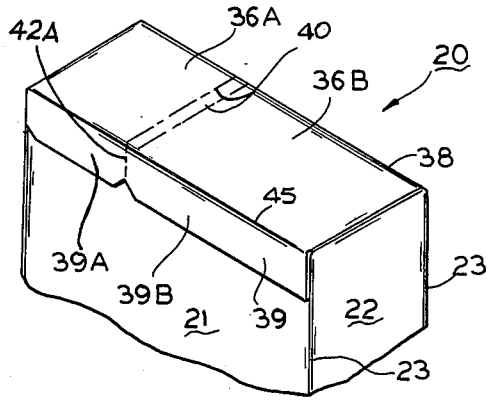
FIG. 3 is an isometric view of a portion of the carton showing the closed condition thereof.

A closure structure is provided for the other end of the tube described and forming upon the opening of such closure structure a pouring spout for the contents of the carton, said closure structure comprising a pair of minor closure flaps 33 connected along a fold line 38 to the minor side walls 22. The minor closure flaps 33 are each formed with gusset elements. Each of said flaps 33 being also connected to a second major closure flap 36 along fold line 23. The flaps 33 are folded to provide sift proofing of the carton when closed, as seen in FIG. 3.

A first major closure flap 34 is folded along the common score line 38 to underlie the gusseted minor closure flaps 33.

The second major closure flap 36 extends from the other major side wall 21 and is foldable with respect thereto along the fold line 38, second major closure flap 36 is foldable to closing position over the minor closure flaps 33 having gusset elements and over the first major closure flap 34.

The first named major closure flap 34 has a transverse line of weakness 41 therein for removal by a lift tab 42 formed in one of the major side walls 21. The second major closure flap 36 is divided into two portions 36A and 36B, these being separable from each other along spaced parallel lines of weakness 40 one which is aligned with the line of weakness 41 in the first major closure flap 34 underlying the minor closure flaps 33.

A small glue flap 39 is connected to second major closure flap 36, and is divided into two portions 39A and 39B, these portions being foldable with respect to the second major closure flap 36 along a fold line 45 and adapted to be glued into position to one of the major side walls 21 as seen in FIG. 3. The small glue flap 39 has a line of weakness 42A therein which is a continuation of one of the lines of weakness 40 separating the two flaps 36A and 36B.

Figure 2:
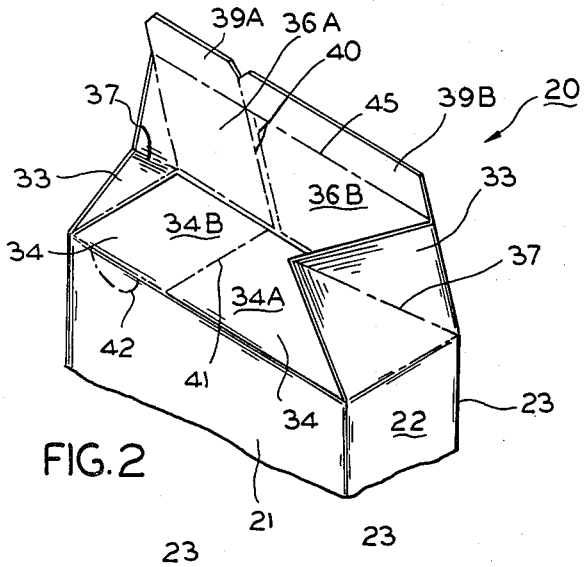
FIG. 2 is an isometric view of a portion thereof showing the steps of folding the closure structure forming an important part of the present invention.

The closing sequence for the carton thus far described is seen in FIG. 2, the gusset folds 37 of the minor closure flap 33 overlying the first major closure flap 34, and being folded in position whereby the second major closure flap can be closed as seen in FIG. 3 with the small glue flap 39 glued in position as seen in FIG. 3.

Figure 4:
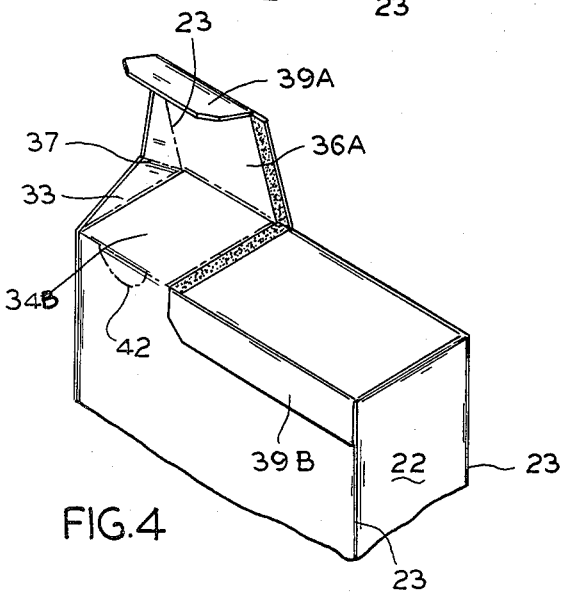
FIG. 4 is an isometric view showing a step in the opening thereof to create a pouring spout.
Figure 5:
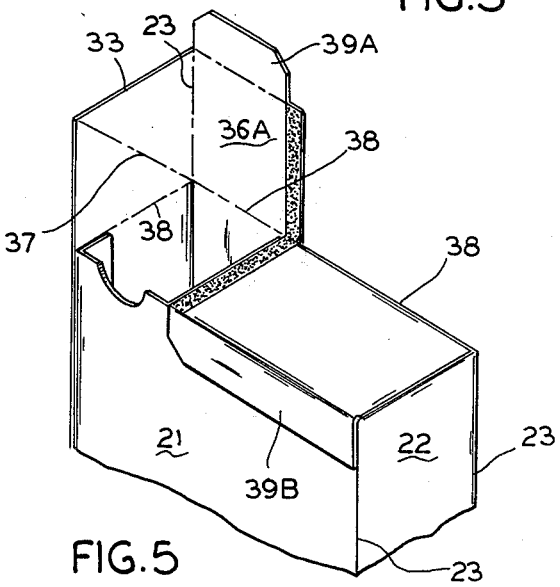
FIG. 5 is a view similar to FIG. 4 showing the spout in the erected position.
Figure 6:
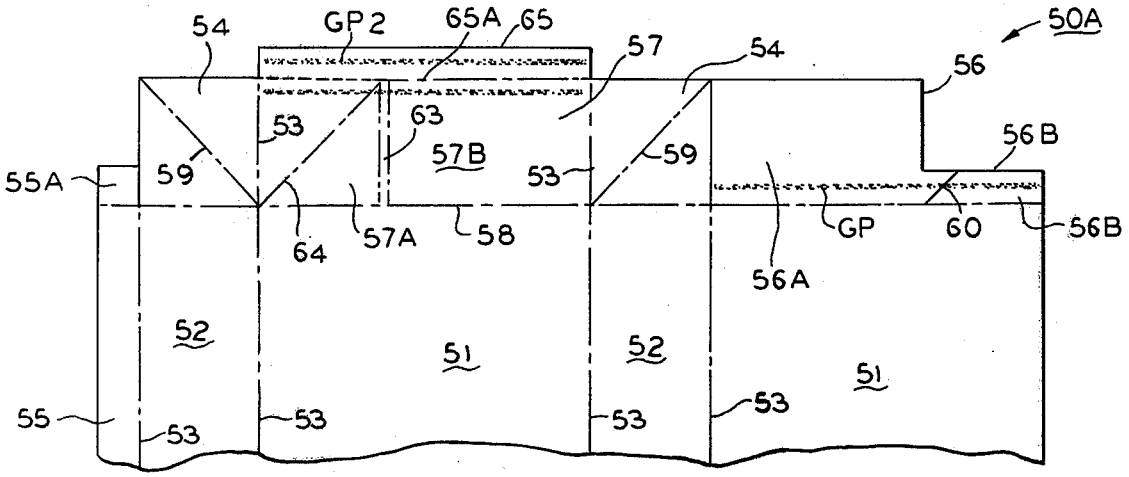
FIG. 6 is a plan view of a portion of a folded and scored carton blank for forming a carton according to another embodiment of the invention.

To open the carton thus far described reference is made to FIGS. 4 and 5, the portion 39A of glue flap 39 being raised as seen in FIG. 4, the portion 34B of the first major closure flap 34 being separated along the line of weakness 41 by lifting of the tab 42. Further lifting of portion 39A provides an open pouring spout as seen in FIG. 5, such spout being capable of reclosing by reverse folding minor closure flap 33 along diagonal fold line 37 at the same time folding the major closure flap 36A along its fold line 38.

Referring now to FIGS. 6 to 12 of the drawings, there is shown another embodiment of the invention also providing a sift proof carton, but having additional advantage that the glue flap structure previously described is left intact, with both the minor closure flap and a portion of the second major closure flap being provided with diagonal score lines to provide gusset folding for reclosure of the carton.

The structure according to this embodiment is denoted by the reference numeral 50 and is formed from a cut and scored blank of paperboard or the like 50A. According to this embodiment, the blank 50A likewise provides a pair of opposed major sidewalls 51 and minor sidewalls 52, these being foldably connected along fold lines 53, there being a connecting flap 55 attached along a fold line 53 of one of the minor side walls 52 to be connected to the remote major sidewall 51 in a manner well understood to provide a tube of rectangular cross section.

In this embodiment, the lower closure structures for such a tube is not described, and it may be formed in accordance with the structure seen with respect to FIGS. 1 to 5 inclusive.

One of the major side walls 51 is foldably connected along a fold line 58 to a first major closure flap 56 adapted to underlie minor closure flaps 54 foldably connected to an extension of the fold lines 53, each minor closure flap 54 having a diagonal fold line 59 therein, so that upon folding of said flaps along the fold lines 59 a pair of gusset flaps will be provided. The other major side wall 51 is foldably connected to a second major closure flap 57 divided into a portion 57A and a portion 57B as defined by lines of weakness 63. The portion 57A of the second major closure flap 57 has a diagonal fold line 65 therein for a purpose as will appear.

The first major closure flap 56 has a major portion 56A and a minor portion 56B defined by a diagonal slit 60. When the tube is formed the portion 56B is glued to a tab extension 55A from the connecting flap 55. The configuration of portions 56A and 56B is such as to provide an opening beneath one of the minor closure flaps 54, the one below the portion 57A when in the closed position.

Figure 7:
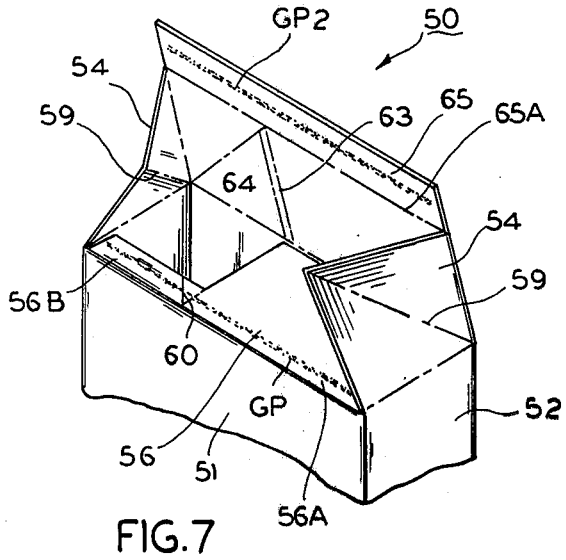
FIG. 7 is an isometric view showing the steps in folding and closing the carton.

This is provided by a glue patch GP extending along the portions 56B and 56A so that upon folding of the minor closure flaps 54, with reference to the one adjacent the first major closure flap 56 the latter will underlie such gusseted flap 54 as seen in FIG. 7.

Figure 8:
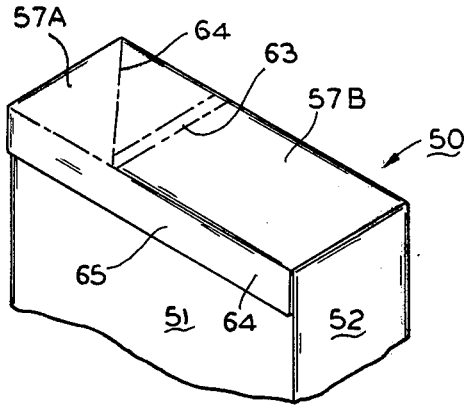
FIG. 8 is a fragmentary isometric view showing the carton in the closed condition thereof.
Figure 9:
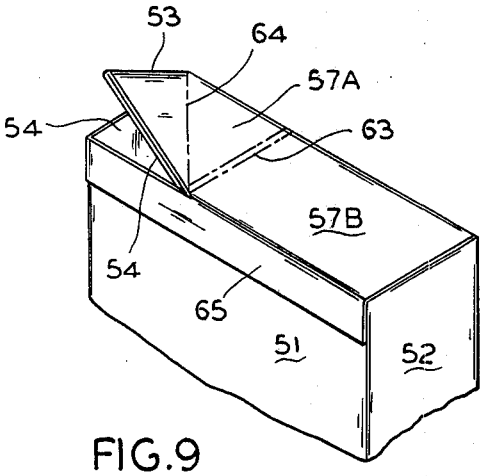
FIG. 9 is an isometric view showing the steps in opening the carton seen in FIGS. 7 and 8.
Figure 10:
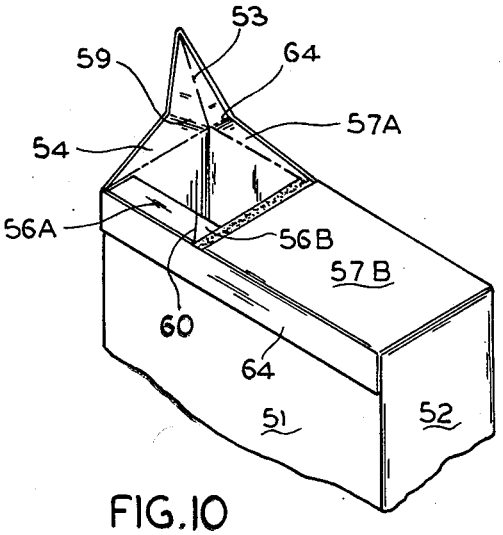
FIG. 10 is a similar isometric view showing another step in the opening thereof.

The minor closure flap 54 adjacent that portion 57A of the second major closure flap 57 folds into position as seen in FIG. 7. The second major closure flap 57 is provided with a small connecting flap 65 foldable with respect to the second major closure flap 57 along a fold line 65A. Glue flap 65 has a glue patch GP2 thereon for adhering the same upon folding as seen in FIG. 8 to the major side wall 51.

Figure 11:
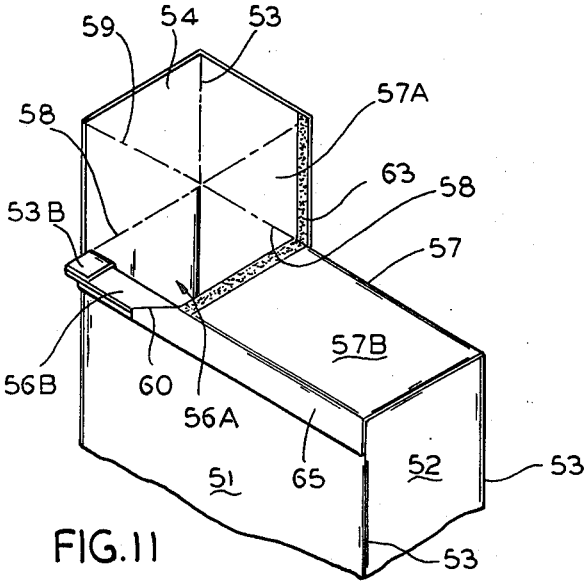
FIG. 11 is a similar isometric view showing the opened carton with the erected pouring spout.
Figure 12:
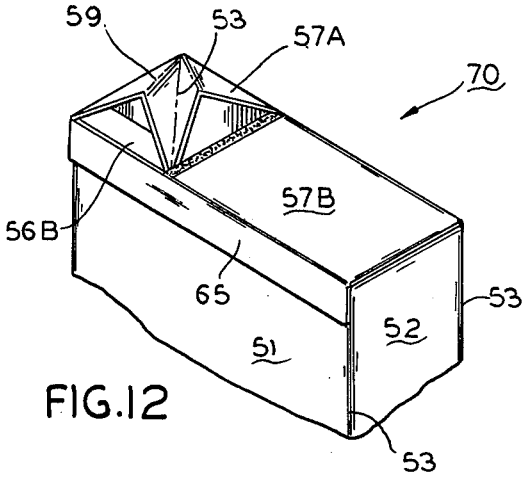
FIG. 12 is a similar view showing the carton being reclosed.

To open the carton of this embodiment flap 57A is raised along its fold line 64 together with the minor closure flap 54, flap 57A being severed from the flap 65. After so doing, the flaps 54 and 57A can be erected as seen in FIG. 11 to form a pouring spout. For reclosure, the gusseted flaps 54 and 57A are reverse folded along the common fold line 53 to be inserted into the open carton, as seen in FIG. 12. The reverse folded flaps are captured in the slot 60 between the portions 56A and 56B of the first major closure flap 56.

Figure 13:
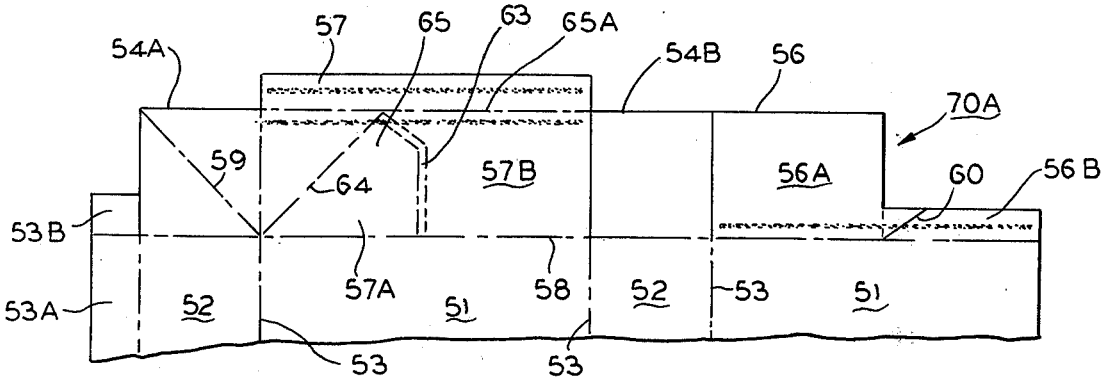
FIG. 13 is a plan view of a portion of a carton blank for a carton according to another embodiment.
Figure 14:
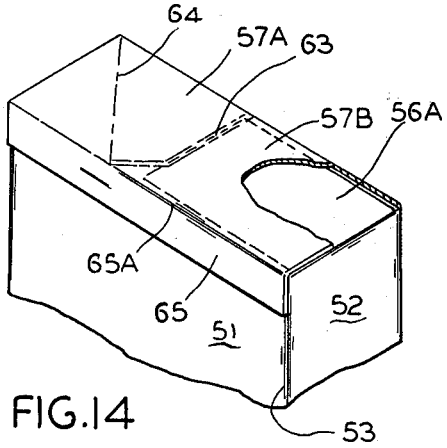
FIG. 14 is an isometric view showing the carton according to this embodiment in the closed condition, certain parts thereof being shown broken away to show details thereof.
Figure 15:
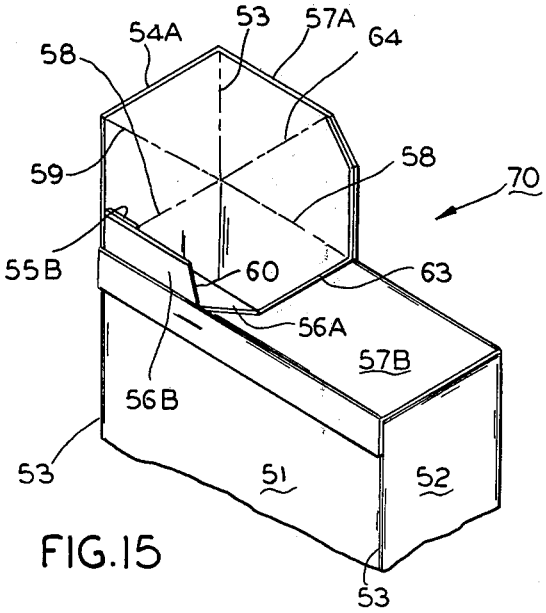
FIG. 15 is a perspective view showing the pouring spout thereof in the erected position.

Referring now to FIGS. 13 to 15, there is shown another embodiment of the invention where the carton is constructed in a fashion similar to that seen in FIGS. 6 to 12 of the drawings. However, in this embodiment of the invention the closure structure is not of a type providing sift resistance at the upper ends of the container, and it is intended that claims to the structure of FIGS. 13 to 15 be generic to all forms disclosed.

Referring now to FIGS. 13 to 15, this third embodiment is noted generally by the reference number 70 and it is formed from a blank 70A seen in FIG. 13. Reference numerals are applied to this figure and to FIGS. 14 and 15 and are like those applied to the embodiment of FIG. 6 except at the points where the structure differs from that of FIG. 6.

In this embodiment the minor closure flaps are referred to by the reference numerals 54A and 54B. Flap 54B does not have a diagonal fold therein, and so is not sift resistant. Flap 54B is not connected to the portion 57B of second major closure flap 57. The folding sequence of the major and minor closure flaps remains the same as before, closure flap 56 underlying closure flap 54B and the gusseted closure flap 54A. In forming the tube, the portion 56B is adhered to the tab 55B. The gluing sequence described with respect to these figures is the same and second major closure flap 57 is adapted to be lightly glued to the gusseted flap 54A and the flap 54B. The small connecting flap 65 is adhered to the opposite wall 51 as with the previous embodiment.

Second major closure flap 57 also has a line of weakness 63 therein enabling the portion 57A to be separated from portion 57B.

As seen in FIG. 15 the raising of the flaps 54A and 57A also raises the portion 56B of the first major closure flap 56. The latter has the slot 60 formed therein as seen in FIGS. 13 and 15, and for reclosure of the carton the flap 56B is moved back into the plane of closure 57B, the flaps 54A and 57A being folded in reverse direction as seen in FIG. 12 to effect a reclosure, the folded edge 57 entering the slot 60 between portions 56A and 56B of the first major closure flap 56.

We claim:

1. In a carton formed from a cut and scored blank of paperboard or the like:

(a) major and minor pairs of sidewalls foldably interconnected to define a tube of rectangular cross-section with first and second end closure structures;

(b) each of said closure structures comprising:

(i) first and second minor closure flaps foldably connected to respective minor sidewalls, each of said first and second minor closure flaps including a pair of gusset elements foldably joined to each other;

(ii) a first major closure flap extending from one of said major sidewalls and foldable to a position underlying certain of said minor closure flaps when the latter are folded to closed position with respect to their related minor sidewalls;

(iii) a second major closure flap extending from the other of said major sidewalls and being connected along side edges thereof to said first and second minor closure flaps and being foldable to closed position overlying said minor closure flaps and said first major closure flap;

(iv) a glue flap extending from an edge of said second major closure flap and being foldable to closed position overlying and secured to a marginal area of said first major sidewall;

(c) said first end closure structure having a portion of said second major closure flap and a portion of said adjacent glue flap detachably connected along a line of weakness from the remaining portions of the second major closure flap and glue flap, respectively, so as to provide a dispensing opening in said closure structure whereby said portions and said first minor closure flap are erectable to form a dispensing opening.

2. A carton according to claim 1, wherein said first major closure flap includes an aperture underlying said dispensing opening.

3. A carton according to claim 1, wherein one portion of said first major closure flap is detachably connected to the remaining portion thereof by a line of weakness generally underlying the line of weakness in said second major closure flap to permit said one portion of said first major closure flap to be detached to provide a dispensing opening in said structure.

* * * * *